US008591667B2

(12) United States Patent
Mittleman et al.

(10) Patent No.: US 8,591,667 B2
(45) Date of Patent: Nov. 26, 2013

(54) APPARATUS AND METHOD FOR CLEANING ELECTRONIC JACKS OF DEBRIS

(71) Applicant: Apple Inc., Cupertino, CA (US)

(72) Inventors: Adam D. Mittleman, San Francisco, CA (US); Stephen Zadesky, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/684,135

(22) Filed: Nov. 21, 2012

(65) Prior Publication Data

US 2013/0167874 A1 Jul. 4, 2013

Related U.S. Application Data

(62) Division of application No. 12/008,601, filed on Jan. 11, 2008, now abandoned.

(60) Provisional application No. 60/961,384, filed on Jul. 20, 2007.

(51) Int. Cl.

| | |
|---|---|
| ***B08B 9/00*** | (2006.01) |
| ***B08B 11/00*** | (2006.01) |
| ***B08B 5/02*** | (2006.01) |
| ***B08B 5/04*** | (2006.01) |

(52) U.S. Cl.
USPC ..... 134/22.18; 134/21; 134/24; 134/37

(58) Field of Classification Search
USPC ..... 134/22.1, 22.18, 37
See application file for complete search history.

(56) References Cited

U.S. PATENT DOCUMENTS

| | | | | |
|---|---|---|---|---|
| 2,846,710 | A | 4/1958 | Haka | |
| 3,897,604 | A | 8/1975 | Weimer | |
| 4,733,428 | A | 3/1988 | Malinge et al. | |
| 4,733,678 | A * | 3/1988 | Bolois | 134/115 R |
| 5,335,703 | A | 8/1994 | deJong | |
| 6,821,025 | B2 | 11/2004 | Gerhard | |
| 2004/0118428 | A1 * | 6/2004 | Stelcher et al. | 134/1 |
| 2005/0134468 | A1 * | 6/2005 | Thomas et al. | 340/630 |
| 2006/0090289 | A1 * | 5/2006 | Kuang | 15/344 |
| 2006/0255166 | A1 | 11/2006 | Imamura et al. | |
| 2009/0019718 | A1 | 1/2009 | Mittleman et al. | |

OTHER PUBLICATIONS

Non-Final Office Action for U.S. Appl. No. 12/008,601, mailed on Feb. 2, 2011, 13 pages.
Final Office Action for U.S. Appl. No. 12/008,601, mailed on Aug. 25, 2011, 17 pages.

* cited by examiner

*Primary Examiner* — Michael Kornakov
*Assistant Examiner* — Natasha Campbell
(74) *Attorney, Agent, or Firm* — Kilpatrick Townsend & Stockton LLP

(57) ABSTRACT

Methods and apparatus are provided for cleaning jacks in portable electronic components. In one embodiment of the present invention, an adaptor plug is designed having a hollow shaft and the end of the plug is designed with holes that communication with the hollow shaft. The plug can be inserted into a jack, which can operate to open one or more switches within the jack, thereby freeing any debris that may have accumulated under the switches. Compressed air can then be applied down the hollow shaft and out the holes in the plug to displace the debris and clean the jack. In another embodiment, the end of the plug can be constructed such that it rotates about an axis to increase the likelihood that the jack will be cleaned.

18 Claims, 3 Drawing Sheets

APPARATUS AND METHOD FOR CLEANING ELECTRONIC JACKS OF DEBRIS

CROSS-REFERENCES TO RELATED APPLICATIONS

This application is a division of U.S. application Ser. No. 12/008,601, filed on Jan. 11, 2008 which claims the benefit of prior filed U.S. Provisional Application No. 60/961,384, filed Jul. 20, 2007, which is incorporated herein by reference in its entirety.

BACKGROUND OF THE INVENTION

This relates to electronic devices and more particularly to methods and apparatus for cleaning jacks, such as audio jacks, that often are adapted to receive a plug.

Portable electronic devices, such as wireless and cellular telephones, digital media players (e.g., music players and video players), and hybrid devices that combine telephone and media playing functionality are widely used in society. These devices are typically configured to provide communications to a user in one or more modes. In some of those modes, the communications can be wireless, such as via a cellular telephone network, a Wi-Fi network, or Bluetooth communications. In those instances, the user interacts with another device or location to receive information in the form of audio, video or both. In either instance, such devices often include jacks that are configured to receive a plug. The plug can provide a number of different interfaces, such as power, audio signals, control signals and data signals.

One problem that can occur with such devices is that the debris can accumulate in the jack which can interfere with normal operations. For example, many individuals place their electronic devices in a large carrier, such as a purse or a briefcase. These electronic devices can include cell phones, such as an iPhone, music players, such as an iPod and/or video game playing systems. In each of those examples, as well as others, the devices all have one or more jacks, and some of those jacks include internal switches that can be OPEN or CLOSED depending on whether a plug is inserted into the jack.

The present invention addresses problems related to the accumulation of one or more materials within the jack that may prevent the switches, or the entire device, from operating properly. One common jack that is often found on such devices, for example, is an audio jack. Most audio jacks include at least three internal contacts—one for a right channel, one for a left channel and one for a ground signal. In addition, some audio jacks may also include an additional contact for a microphone.

When a plug is inserted into the jack, various portions of the plug may contact with various 30 portions of the jack to complete separate circuits. In addition, one or more switches are activated which, at a minimum, act to hold the plug in the jack. If debris is already present within the jack, the debris can be forced under the switch, such that it becomes difficult, if not virtually impossible, to remove without potentially damaging the device.

Some individuals may attempt to clean out the debris by shaking the device, but this could potentially destroy the device if, for example, the device utilizes an internal hard drive. Even if a hard drive is not present, the potential for damage is always present if the device is significantly shaken.

Another way in which individuals may try to remove the debris from the jack is by blowing into the jack. While this can occur when the user simply blows into the jack from his or her mouth, this approach can potentially introduce even more problems to the situation, as it may result in the application of moisture to the contacts.

One alternative to blowing air out of one's mouth would be to apply a source of compressed air to the jack. For example, cans of compressed air are marketed for cleaning debris out of keyboards on computers, which could be applied to attempts to clean out an audio jack on a portable electronic device. Even this potential solution, however, has its drawbacks. If the jack being cleaned has switches, those switches may have closed and trapped debris within the jack that, in all likelihood, will not be removed from the mere application of compressed air. In addition, in many instances, the user will not be able to see whether the debris has been cleared out because the debris may be located under the switch.

Accordingly, what is needed are methods and apparatus for providing users with the ability to clean out the jacks located on portable electronic devices.

BRIEF SUMMARY OF THE INVENTION

Methods and apparatus are provided for cleaning out jacks that are typically located on portable electronic devices.

In one embodiment, an adaptor plug is designed with an internal hollow channel, an opening at the opposite end of the plug through which air can be applied, and a series of one or more openings at the plug end that are in communication with the hollow channel to provide a way for air applied to the hollow channel to exit the plug.

A small hose or other conduit can be applied to the opening through which air or compressed air can be applied. In this manner, the opening may also include apparatus to temporarily secure the conduit to the adaptor plug, in order to minimize the amount of applied air that might otherwise leak out of the adaptor during the cleaning process. A consumer could place the adaptor plug in the jack, couple the conduit to the plug, and then apply compressed air through the conduit to clean the jack.

In some embodiments, a source of compressed air can also be constructed such that the adaptor plug is physically connected to the source, such that a consumer could purchase and use the apparatus as a single unit. In this manner, the consumer would simply place the adaptor plug in the jack and then further depress the source of compressed air, which would cause the compressed air to travel the length of the hollow channel and exit the holes at the end of the plug, thereby applying cleansing air to the jack.

In both of these instances, the insertion of the plug into the jack would open switches within the jack, thereby freeing any debris that might have been trapped under the closed switch. The application of compressed air then moves the debris from under the switches. The application of compressed air can continue as the adaptor plug is removed from the jack, to further clean the debris from the jack.

One alternative to the present invention which can further increase the cleaning capability of the device is for the end portion of the adaptor plug to be free to rotate, such that the application of compressed air causes it to rotate, thereby ensuring that compressed air is applied throughout the jack. This may be accomplished through the use of small flanges that extend within the hollow channel of the adaptor plug, and which are configured such that force from the application compressed air is directed onto the flanges causing the end portion to rotate.

This embodiment may also be combined with the continued application of compressed air during removal of the adaptor plug from the jack. In this manner, debris would be forced from the jack as the adaptor plug is removed and the switches are closed.

BRIEF DESCRIPTION OF THE DRAWINGS

The above and other features of the present invention, its nature and various advantages will become more apparent upon consideration of the following detailed description, taken in conjunction with the accompanying drawings, in which like reference characters refer to like parts throughout, and in which.

DETAILED DESCRIPTION OF THE INVENTION

Figure 1:
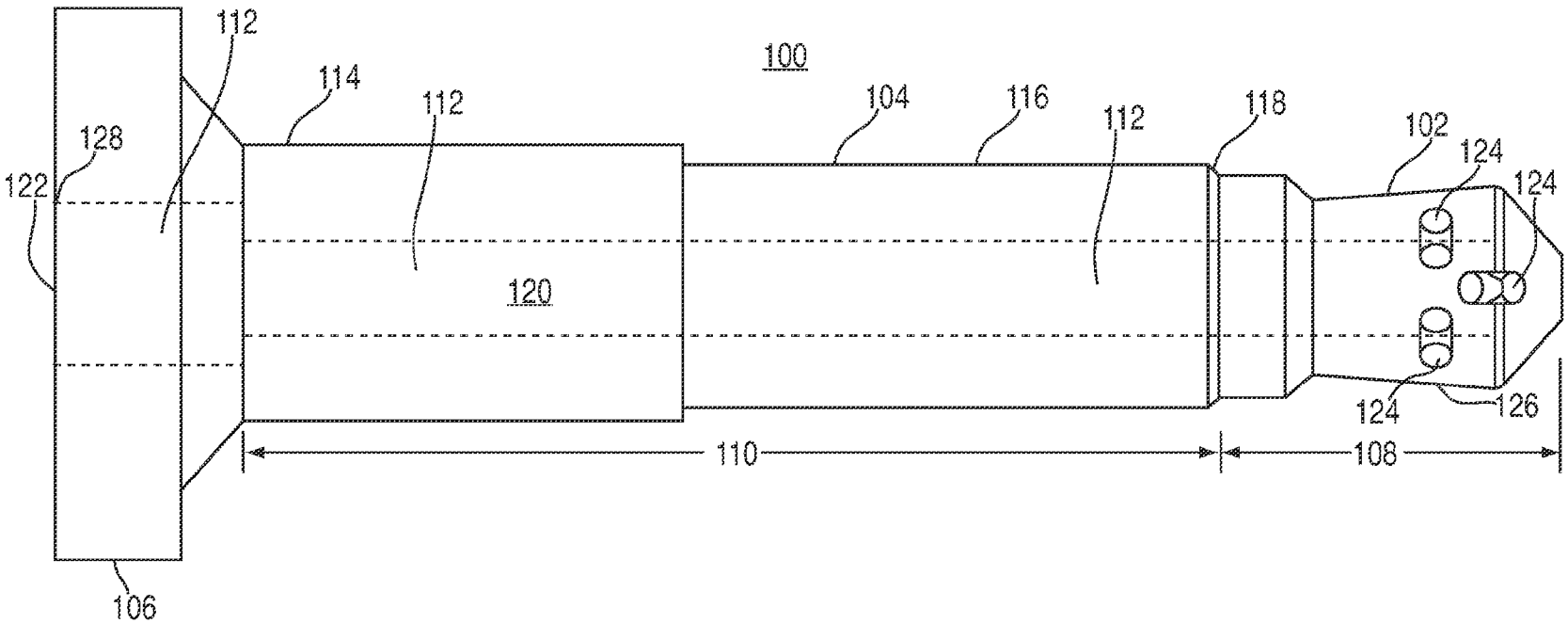
FIG. 1 is a side view schematic diagram of an adaptor plug that is used in accordance with the principles of the present invention.

FIG. 1 shows a side view, schematic diagram of an illustrative audio adaptor device 100, which is constructed in accordance with the principles of the present invention. audio adaptor 100 may include plug end 102, shaft 104 and connector end 106. In one embodiment of the present invention, plug 102 is a 3.5 millimeter plug formed from one or more pieces of brass, a copper alloy or other suitable electrically conductive material (generally referred to hereinafter as "metal"), which can alternate with pieces of insulating material. As shown in FIG. 1, plug 102 is constructed of metal (as shown by reference 108), while shaft 104 (the remainder of adaptor plug 100) is constructed of insulating material.

Plug 102 may extend as a channel 112 internally within shaft 104 to connector end 106, which is also metal. It may be advantageous to form plug 102, connector end 106 and channel 112 from a single piece of metal (referred to as post 120), in which case insulating rings 114, 116 and 118 would all be assembled by sliding them on to the single piece of metal (i.e., ring 114 would be placed first, ring 116 second and ring 118 last). Plug 102 may be constructed of any number of metal portions and insulating portions to simplify the manufacturing process.

For example, all of the components that are used to construct plug 102 can placed and/or fabricated on channel portion 112 of center post 120. In one embodiment, during the assembly process, insulating rings 114, 116 and 118 can be injection molded in place on post portion 120 at one time. It should be noted that while insulating rings 114, 116 and 118 are described as individual sub-components, that is only how the "rings" would look to a user after the assembly is complete. All of the "insulating rings" can be formed at one time from one insulating material through, for example, an injection molding process, such that all of the "insulating rings" are, in actuality, a single subassembly (which can be the situation if adaptor plug 102 were to include multiple metal components).

In typical plug assemblies, post 120 is a solid shaft that provides electrical contact between the end of plug 102 and connector end 106. In accordance with the present invention, however, post 120 includes a hollow shaft portion 112 that is in direct communication with opening 122 in connector end 106. In addition, plug portion 102 includes one or more openings that are also in direct communication with shaft portion 112.

In accordance with the present invention, adaptor plug 100 would be inserted into a jack to be cleaned, which would result in extended portion 126 of plug portion 102 opening a switch within the jack (not shown). Compressed air or gas would then be caused to travel from opening 122, down shaft portion 112 until it exited out holes 124 in plug portion 102. The exiting air would dislodge debris which previously had been trapped by the closed switches (not shown) in the jack. In some embodiments, the outer surface of plug portion 102, shaft 104, or both may include one or more ridges, receptacles or other features extending along the axis of shaft 104 for directing or collecting debris dislodged from the jack.

In some embodiments, instead of compressed air traveling through shaft portion 112 to holes 124, a vacuum or compressor may draw in air from the area between plug 102 and the jack in which the plug is inserted/through holes 124, and up shaft portion 112 into a receptacle. Holes 124 and shaft portion 112 may be sized such that debris in the jack may travel through plug 102 and out of the jack.

Opening 122 can include a connector ring 128 or other coupling mechanism which can be used to temporarily connect a hose or other conduct (not shown) between a source of compressed air and adaptor plug 100. In this manner, a single adaptor plug 100 can be utilized with different sources of compressed air, as each source is expended.

Figure 2:
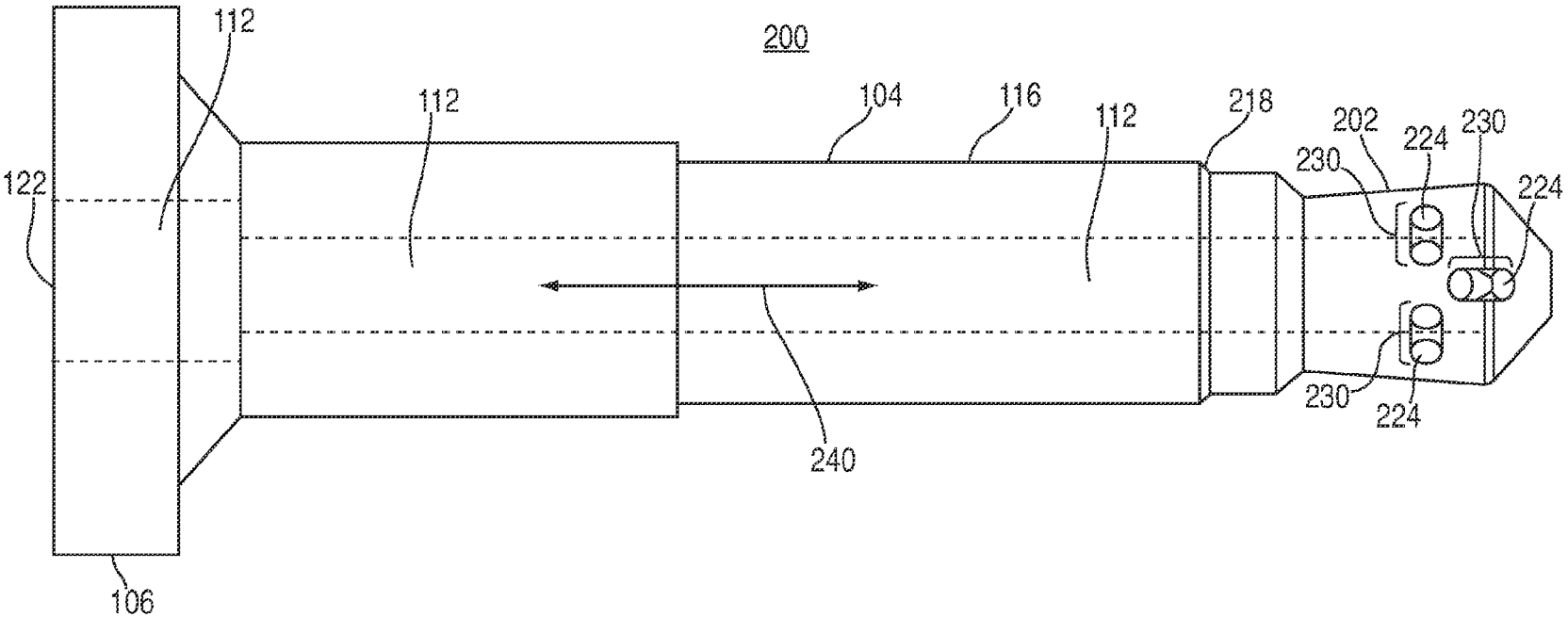
FIG. 2 is a side view schematic diagram of an adaptor plug that is used in accordance with the principles of the present invention.

FIG. 2 shows an alternate embodiment of the present invention in adaptor plug 200. Adaptor plug 200 is similar to adaptor plug 100 in many aspects (in which case the same reference numerals are used). Adaptor plug 200 varies from adaptor plug 100 at least because plug portion 202 is manufactured such that it is able to rotate about axis 240, instead of being a stationary component (e.g., plug portion 202 is rotationally mounted on shaft portion 112). In some embodiments, the entire plug 200 may instead rotate about axis 240. In this instance, insulating ring 218 may be formed of insulating material that resists wear that may be caused by the rotation of plug portion 102.

In addition, the holes formed in the plug portion, in this case, holes 224, may be formed such that one or more flanges 230 are formed within the channel portion 112 of plug portion 202. Moreover, flanges 230 can be formed such that they are angled within channel portion 112 so that compressed air passing down channel portion 112 will be converted into rotational kinetic energy, which will cause plug portion 202 to rotate about axis 240. The rotation of plug portion 202, while compressed air is exiting holes 224, may result in additional cleansing occurring within the jack (not shown). In some embodiments, the user may control the orientation of flanges 230 to vary or stop the rotation of plug portion 202, or the user may control the friction between plug portion 202 and the audio jack (e.g., the contact between insulating ring 218 and the audio jack) to control the rotation of the apparatus.

In accordance with the present invention, it also may be advantageous to continue the application of compressed air as adaptor plugs 100 and 200 are removed from the jack being cleaned. This may help force the debris that was dislodged from the switch (not shown) in the jack, to be removed from the jack entirely. In that manner, plug portion 202 would continue to rotate about axis 240 as long as compressed air was still being provided down channel portion 112. Compressed air may be provided in bursts, or at different pressures to cause plug portion 202 to selectively rotate, and clean dirtier portions of the jack more thoroughly (e.g., by remaining longer on dirtier portions of the jack).

Figure 3:
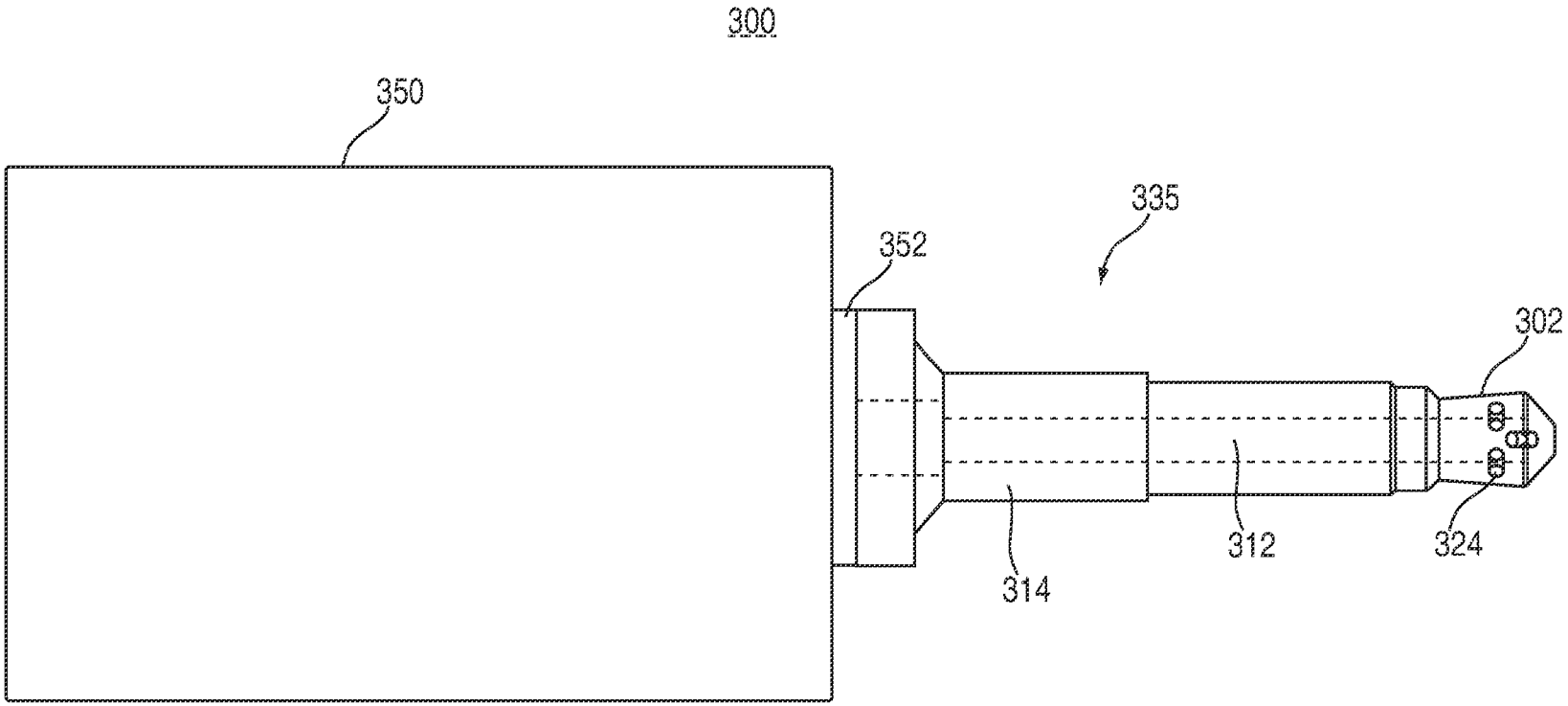
FIG. 3 is schematic diagram of a electronics jack cleaning device constructed in accordance with the principles of the present invention.

FIG. 3 shows side schematic view of jack cleaning device 300, which is constructed in accordance with the principles of the present invention. Cleaning device 300 includes adaptor plug 335 and compressed air source 350. Adaptor plug 335 may be constructed in a manner similar to adaptor plugs 100 or 200 (of FIGS. 1 and 2), such that adaptor plug 335 includes a plug portion 302 and a shaft portion 314. Running the length of shaft portion 314 is channel 312, which is in communication with a valve (not shown) that controls whether compressed air is expelled from source 350 (in which case the compressed air would travel down channel 312 and be forced out holes 324). Cleaning device 300 also includes sealing region 352, which provides a region for plug portion 335 to be depressed against the body of compressed air source 350 (thereby causing the compressed air to be expelled).

Cleaning device 300 provides users with a single unit that can be used to clean electronic component jacks, particularly those with switches located therein. Adaptor plugs 100 and 200 are relatively small components that may be misplaced. In addition, since the unit would be recycled or thrown away once the compressed air is expended, it may be easier to remember to replace the expended unit. On the other hand, it is also likely that the use of adaptor plugs 100 and 200 will be less expensive than the use of device 300. Accordingly, cleaning device 300 may include a reusable compressed air source 350 that may be selectively coupled to single use or limited use adaptor plugs 335. In some embodiments, adaptor plugs having different sizes (e.g., 3.5 mm plug, 30-pin connector plug, USB plug) may be selectively coupled to compressed air source 350.

Thus it is seen that methods and apparatus for cleaning jacks in portable electronic components are provided. It is understood that the apparatus and methods shown in the figures discussed above are merely illustrative and that these methods and apparatus may be modified, added or omitted. Those skilled in the art will appreciate that the invention can be practiced by other than the described embodiments, which are presented for purposes of illustration rather than of limitation, and the invention is limited only by the following claims.

What is claimed is:

1. A method for cleaning a jack comprising a switch, the method comprising:

inserting an adaptor plug into the jack, wherein the inserting causes the switch to change from a closed state of the switch to an open state of the switch; and once the adaptor plug has been inserted into the jack and once the switch has changed from the closed state to the open state, forcing a gas successively through an internal hollow channel within the adaptor plug and through a hole in the adaptor plug that is in communication with both the internal hollow channel and the outside of the adaptor plug, wherein the forced gas removes debris that was trapped under the switch when the switch was in the closed state;

wherein the forcing comprises blowing the gas through an open end of the internal hollow channel and towards the hole, and wherein the blown gas exits the internal hollow channel through the hole for removing the debris from the jack along the outside of the adaptor plug; and wherein the outer surface of the adaptor plug directs the debris as the blown gas removes the debris along the outside of the adaptor plug.

2. The method of claim 1, further comprising coupling a compressed gas source to an open end of the internal hollow channel, wherein the forcing comprises blowing the gas from the compressed gas source.

3. The method of claim 1, wherein the forcing causes a plug portion of the adaptor plug to rotate with respect to a shaft portion of the adaptor plug, wherein the hole is in the plug portion, and wherein at least a portion of the internal hollow channel is within the shaft portion.

4. The method of claim 3, wherein the forcing causes the plug portion to rotate about an axis of the internal hollow channel.

5. The method of claim 1, wherein the forcing comprises forcing the gas in distinct bursts.

6. The method of claim 1, wherein the gas comprises compressed air.

7. The method of claim 1, wherein the jack is configured to receive a 3.5 millimeter plug.

8. A method for cleaning a jack comprising a switch, the method comprising:

inserting an adaptor plug into the jack, wherein the inserting causes the switch to change from a closed state of the switch to an open state of the switch;

once the adaptor plug has been inserted into the jack and once the switch has changed from the closed state to the open state, forcing a gas successively through an internal hollow channel within the adaptor plug and through a hole in the adaptor plug that is in communication with both the internal hollow channel and the outside of the adaptor plug, wherein the forced gas removes debris that was trapped under the switch when the switch was in the closed state; and at least partially removing the adaptor plug from the jack during the forcing.

9. The method of claim 8, further comprising coupling a vacuum to an open end of the internal hollow channel, wherein the forcing comprises drawing the gas from outside the adaptor plug, through the hole, into the internal hollow channel, and then through the open end of the internal hollow channel and into the vacuum.

10. The method of claim 8, wherein the drawn gas exits the internal hollow channel through the open end of the internal hollow channel for removing the debris from the jack along the inside of the adaptor plug.

11. The method of claim 8, wherein the forcing causes at least a portion of the adaptor plug to rotate within the jack.

12. The method of claim 8, further comprising coupling a compressed gas source to an open end of the internal hollow channel, wherein the forcing comprises blowing the gas from the compressed gas source through the open end of the internal hollow channel and towards the hole.

13. The method of claim 12, wherein the blown gas exits the internal hollow channel through the hole for removing the debris from the jack along the outside of the adaptor plug.

14. A method for cleaning a jack comprising a switch, the method comprising:

inserting an adaptor plug into the jack, wherein the inserting causes the switch to change from a closed state of the switch to an open state of the switch; and once the adaptor plug has been inserted into the jack and once the switch has changed from the closed state to the open state, forcing a gas successively through an internal hollow channel within the adaptor plug and through a hole in the adaptor plug that is in communication with both the internal hollow channel and the outside of the adaptor plug, wherein the forced gas removes debris that was trapped under the switch when the switch was in the closed state; and rotating at least a portion of the adaptor plug within the jack during the forcing.

15. The method of claim 14, wherein the forcing comprises drawing the gas from outside the adaptor plug, through the hole, and then into the internal hollow channel, and wherein the drawn gas exits the internal hollow channel through an open end of the internal hollow channel for removing the debris from the jack along the inside of the adaptor plug.

16. The method of claim 14, further comprising at least partially removing the adaptor plug from the jack, wherein the removing causes the switch to change from the open state to the closed state.

17. The method of claim 14, further comprising coupling a vacuum to an open end of the internal hollow channel, wherein the forcing comprises drawing the gas from outside the adaptor plug, through the hole, into the internal hollow channel, and then through the open end of the internal hollow channel and into the vacuum.

18. The method of claim 14, wherein the forcing comprises forcing the gas in distinct bursts.

* * * * *